US010252393B2

(12) United States Patent
Torikai et al.

(10) Patent No.: US 10,252,393 B2
(45) Date of Patent: Apr. 9, 2019

(54) COMPONENT MANUFACTURING METHOD AND POLISHING APPARATUS

(71) Applicant: CANON KABUSHIKI KAISHA, Tokyo (JP)

(72) Inventors: Takehiro Torikai, Saitama (JP); Hitoshi Hashizume, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/048,968

(22) Filed: Jul. 30, 2018

(65) Prior Publication Data

US 2018/0333822 A1 Nov. 22, 2018

Related U.S. Application Data

(63) Continuation of application No. 14/332,789, filed on Jul. 16, 2014, now Pat. No. 10,052,737.

(30) Foreign Application Priority Data

Jul. 22, 2013 (JP) ..... 2013-151650
Jul. 22, 2013 (JP) ..... 2013-151651

(51) Int. Cl.
*B24B 13/02* (2006.01)
*B24B 13/005* (2006.01)

(52) U.S. Cl.
CPC ..... *B24B 13/02* (2013.01); *B24B 13/005* (2013.01)

(58) Field of Classification Search
CPC ..... B24B 13/005; B24B 13/02
See application file for complete search history.

(56) References Cited

U.S. PATENT DOCUMENTS 2,105,175 A * 1/1938 Anderson ..... B24B 13/02 351/178
2,129,522 A * 9/1938 Burroughs ..... B24B 13/02 451/270
3,330,075 A * 7/1967 Suddarth ..... B24B 13/02 451/277
3,886,696 A * 6/1975 Bruck ..... B24B 13/005 269/22
3,900,972 A * 8/1975 Rupp ..... B24B 13/02 451/270
3,916,574 A * 11/1975 Prunier ..... B24B 13/02 451/277
4,173,848 A * 11/1979 Ikeno ..... B24B 13/02 451/159

(Continued)

FOREIGN PATENT DOCUMENTS

DE 2728915 A1 * 5/1979 ..... B24B 13/02
EP 0567894 A1 * 11/1993 ..... B24B 13/005

(Continued)

*Primary Examiner* — Marc Carlson
(74) *Attorney, Agent, or Firm* — Canon U.S.A., Inc. IP Division

(57) ABSTRACT

A component manufacturing method includes causing a holding member to hold a workpiece such that a spherical center of a processed surface of the workpiece is located on a supporting member; rotating the workpiece by rotating the holding member; and polishing the workpiece by moving the supporting member to move the workpiece on a polishing tool, with the spherical center of the processed surface located at a spherical center of a processing surface of the polishing tool.

20 Claims, 6 Drawing Sheets

(56) References Cited

U.S. PATENT DOCUMENTS 4,216,626 A * 8/1980 Starp ..... B24B 13/023 451/163
4,598,502 A * 7/1986 Lombard ..... B24B 13/02 451/277
4,653,234 A * 3/1987 Lombard ..... B24B 13/02 451/390
5,241,792 A * 9/1993 Naka ..... B24B 27/033 451/24
5,291,692 A * 3/1994 Takahashi ..... B24B 13/005 451/388
5,482,495 A * 1/1996 Mayahara ..... B24B 13/02 451/24
5,951,375 A * 9/1999 Mandler ..... B24B 13/01 451/384
6,077,148 A * 6/2000 Klein ..... B24B 1/00 451/11
6,123,610 A * 9/2000 Larsen ..... B24B 13/02 451/285
6,247,999 B1 * 6/2001 Tokiwa ..... B24B 19/20 451/57
6,855,042 B1 * 2/2005 Werner ..... G02C 13/005 451/384
7,338,346 B2 * 3/2008 Kuebler ..... B24B 13/02 451/11
7,455,569 B2 * 11/2008 Schafer ..... B24B 13/0037 451/11
2002/0061717 A1 * 5/2002 Goulet ..... B24B 13/005 451/42
2003/0129925 A1 * 7/2003 Toyoshima ..... B24B 13/005 451/5
2004/0229553 A1 * 11/2004 Bechtold ..... B24B 13/01 451/42
2005/0101226 A1 * 5/2005 Ferme ..... B24B 13/015 451/36
2006/0009126 A1 * 1/2006 Kuebler ..... B24B 13/02 451/5
2007/0021036 A1 * 1/2007 Kuebler ..... B24B 13/02 451/5
2007/0293128 A1 * 12/2007 Schafer ..... B24B 13/0037 451/7
2008/0305723 A1 * 12/2008 Philipps ..... B24B 13/02 451/158
2010/0151773 A1 * 6/2010 Leonhardt ..... B24B 13/02 451/283
2012/0045975 A1 * 2/2012 Kojima ..... B24B 13/02 451/294
2014/0235142 A1 * 8/2014 Monnoyeur ..... B24B 13/00 451/11
2014/0248824 A1 * 9/2014 Satake ..... B24B 13/02 451/177
2015/0024663 A1 * 1/2015 Torikai ..... B24B 13/005 451/42

FOREIGN PATENT DOCUMENTS

GB 1266111 A * 3/1972 ..... B24B 13/0012
JP S53-018088 A 2/1978
JP 2008-260091 A 10/2008
JP WO 2011092748 A1 * 8/2011 ..... B24B 13/02

* cited by examiner

COMPONENT MANUFACTURING METHOD AND POLISHING APPARATUS

CROSS-REFERENCE TO RELATED APPLICATIONS

This application is a Continuation of U.S. patent application Ser. No. 14/332,789, filed Jul. 16, 2014, which claims the benefit of Japanese Patent Application No. 2013-151650, filed Jul. 22, 2013, and Japanese Patent Application No. 2013-151651, filed Jul. 22, 2013, all of which are hereby incorporated by reference herein in their entirety.

BACKGROUND OF THE INVENTION

Field of the Invention

The present invention relates to a method for manufacturing a component, such as a spherical lens, particularly used in optical devices, and also relates to a polishing apparatus.

Description of the Related Art

A spherical lens, which is an optical element used in optical devices, is polished by supplying abrasive slurry to a polishing tool having a spherical operating surface similar to the surface of the spherical lens, causing the polishing tool to apply pressure to a workpiece, and also causing the polishing tool to rotate the workpiece and make the workpiece perform an oscillating movement. The oscillating movement is performed, with the center of curvature of the surface of the workpiece coinciding with the center of curvature of the surface of the polishing tool. This oscillating movement transfers the surface shape of the polishing tool to the optical element, so that a desired shape of the optical element can be obtained.

As a polishing apparatus that polishes a spherical lens, Japanese Patent Publication No. 6-65460 describes a polishing apparatus that performs polishing by applying pressure toward the spherical center of a polishing plate to make the polishing plate oscillate. Japanese Patent No. 4347374 describes a polishing apparatus that includes linear motion shafts provided with linear guides. By controlling each of the linear motion shafts, this polishing apparatus performs an oscillating movement in which the center of curvature of the surface of the workpiece coincides with the center of curvature of the surface of the polishing tool.

Each of the polishing apparatuses described in Japanese Patent Publication No. 6-65460 and Japanese Patent No. 4347374 is configured to make the polishing plate oscillate and is distant from the spherical center. Therefore, since the range of oscillation is large, it is necessary to improve apparatus stiffness and movement accuracy to achieve a high-accuracy oscillating movement, and this increases the apparatus cost. Lowering the cost of the polishing apparatus leads to an increase in spherical center error due to a decrease in apparatus stiffness and movement accuracy. This causes a nonuniform distribution of contact pressure between the surface of the workpiece and the surface of the polishing tool, and makes it difficult to achieve desired shape accuracy.

SUMMARY OF THE INVENTION

A component manufacturing method according to an aspect of the present invention is a method for manufacturing a component by moving a workpiece with respect to a polishing tool to polish the workpiece, and includes causing a holding member to hold the workpiece such that a spherical center of a processed surface of the workpiece is located on a supporting member; rotating the workpiece by rotating the holding member; and polishing the workpiece by moving the supporting member to move the workpiece on the polishing tool, with the spherical center of the processed surface located at a spherical center of a processing surface of the polishing tool.

A polishing apparatus according to another aspect of the present invention is an apparatus that polishes a workpiece by moving the workpiece with respect to a polishing tool, and includes a holding member configured to hold the workpiece; a work rotating mechanism configured to rotate the holding member; a supporting member configured to come into contact with the holding member; and a moving mechanism configured to move the supporting member. A rotation transmitting member is coupled to the holding member, and the rotation transmitting member transmits rotation from the work rotating mechanism to the holding member.

A component manufacturing method according to another aspect of the present invention is a method for manufacturing a component by moving a workpiece with respect to a polishing tool to polish the workpiece, and includes holding the workpiece such that a spherical center of a processed surface of the workpiece is located on a supporting member; attaching the supporting member to an articulated arm formed by a plurality of arms coupled together by a plurality of joints, with the spherical center of the processed surface located at a spherical center of a processing surface of the polishing tool; and polishing the workpiece by driving the joints to move the supporting member such that the workpiece moves on the polishing tool.

A polishing apparatus according to another aspect of the present invention is an apparatus that polishes a workpiece by moving the workpiece with respect to a polishing tool, and includes a holding member configured to hold the workpiece; a supporting member configured to come into contact with the holding member; and an articulated arm configured to move the supporting member, the articulated arm being formed by a plurality of arms coupled together by a plurality of joints. The supporting member is moved by driving each of the plurality of joints of the articulated arm.

Further features of the present invention will become apparent from the following description of exemplary embodiments with reference to the attached drawings.

DESCRIPTION OF THE EMBODIMENTS

First Embodiment

Figure 1A:
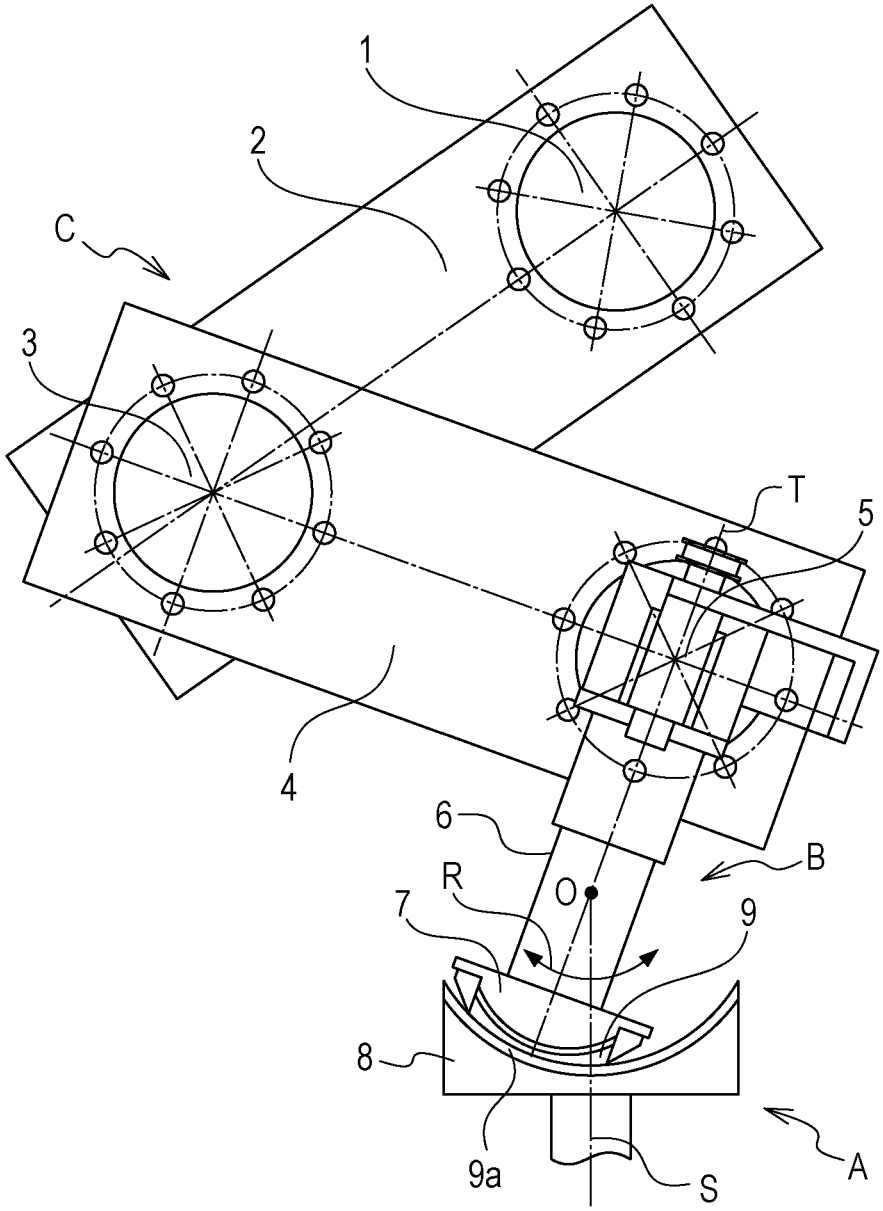
FIGS. 1A and 1B illustrate a first embodiment of the present invention.
Figure 1B:
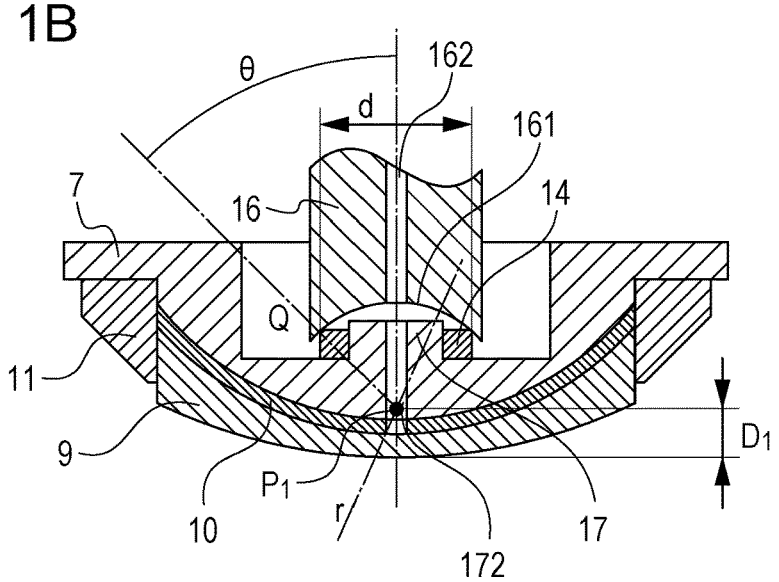
Figure 2:
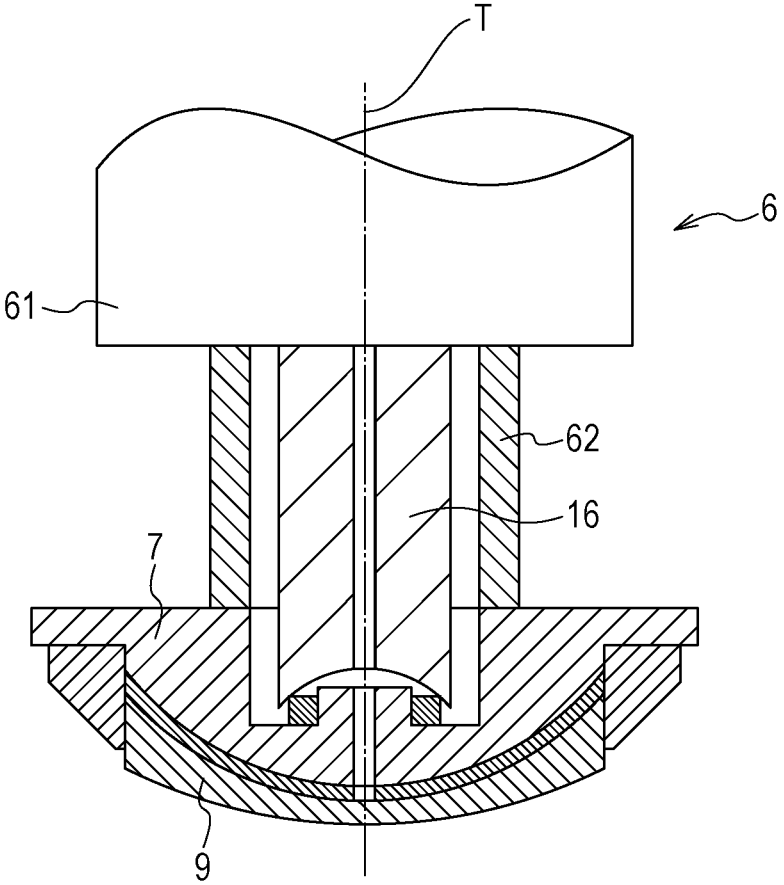
FIG. 2 illustrates the first embodiment of the present invention.

A first embodiment of a component manufacturing method according to the present invention will now be described. FIGS. 1A and 1B illustrate the first embodiment. FIG. 1A is a schematic diagram of a polishing apparatus according to the first embodiment. FIG. 2 is a partial enlarged cross-sectional view of FIG. 1A. The polishing apparatus used in the component manufacturing method of the first embodiment includes a polishing tool unit A, a workpiece holding unit B, and a moving mechanism unit C.

Referring to FIG. 1A, the polishing tool unit A includes a polishing tool 8, which may be rotated by a tool rotating mechanism (not shown) about a tool central axis S. A polishing tool that is known in the art may be used as the polishing tool 8. For example, a layer of urethane sheets bonded together or a layer of pitch may be used as the polishing tool 8. As used herein, the term "polishing tool" includes a grinding tool.

The workpiece holding unit B includes a supporting member 6 and a holding member 7 for holding a workpiece 9. The holding member 7 holds the workpiece 9 such that an optical axis passing through a spherical center O of a processed surface 9*a* of the workpiece 9 is located on a central axis of the holding member 7. A spherical center of the workpiece 9 may be either a spherical center of the workpiece 9 before polishing or a spherical center of a shape to be obtained by polishing (i.e., target shape), but the latter is more preferable.

As illustrated in FIG. 2, a work rotating mechanism 61 rotates the supporting member 6 about a central axis T to rotate the holding member 7. The supporting member 6 has a rotation transmitting member 62 and the work rotating mechanism 61 along the outer periphery thereof. An end portion of the rotation transmitting member 62 is coupled to the work rotating mechanism 61, and the other end portion of the rotation transmitting member 62 is coupled to the holding member 7. This transmits the rotation of the work rotating mechanism 61 to the holding member 7. The rotation transmitting member 62 and the work rotating mechanism 61 may be disposed between the holding member 7 and an arm joint 5 illustrated in FIG. 1A. For example, an elastic member may be used as the rotation transmitting member 62. The elastic member may be made of a rubber material or a foamed urethane material. The rotation transmitting member 62 may have a columnar, cylindrical, or bellows-like shape. The rotation transmitting member 62 may be a coil-like member, such as a coil spring, or may be a bellows-like metal member. A moment stiffness (i.e., a load (Nmm) necessary for inclination of 1 degree) produced around a center of curvature $P_1$ of a concave spherical portion 161 of a coupling part 16 (see FIG. 1B) may be 15 Nmm/degree or less. To make the moment stiffness 15 Nmm/degree or less, it is necessary to consider the shape or the physical properties of the rotation transmitting member 62. Since the rotation transmitting member 62 is a member that transmits torque from the work rotating mechanism 61 to the holding member 7, the shape or the physical properties of the rotation transmitting member 62 is or are changed within a range in which the rotation transmitting member 62 is not broken by stress resulting from a torsion moment.

Using an elastic member as the rotation transmitting member 62 can reduce a moment stiffness around any axis intersecting the rotation axis of the workpiece 9. Therefore, even if a spherical center error of the polishing apparatus is relatively large, that does not block the force of enabling the workpiece 9 to follow the movement of the polishing tool 8. Thus, a pressure from the polishing tool 8 is uniformly applied to the surface of the workpiece 9, and good shape accuracy can be achieved. Since the rotation speed of the workpiece 9 is mechanically controlled by the rotation transmitting member 62, a moving speed (polishing speed) of the surface of the workpiece 9 relative to the surface of the polishing tool 8 can be controlled, and better shape accuracy can be achieved. Since the polishing speed can be set properly in accordance with the material and the target shape accuracy, the processing time can be shortened. Also, wear of the surface of the polishing tool 8 or wear of a coupling portion between the holding member 7 and the supporting member 6 does not cause the moving speed (polishing speed) of the surface of the workpiece 9 relative to the surface of the polishing tool 8 to change with time. Therefore, it is possible to stabilize the speed of removing the surface of the workpiece 9, and ensure good shape accuracy of a processed component.

The polishing tool 8 may be rotated by the tool rotating mechanism (not shown). To make the speed of the surface of the workpiece 9 relative to the surface of the polishing tool 8 constant, the rotation speed of the workpiece 9 may be made equal to that of the polishing tool 8.

A pressure mechanism may be provided, which applies pressure by moving the supporting member 6 in a direction parallel to the central axis T to press the workpiece 9 against the polishing tool 8.

The moving mechanism unit C is configured to move the supporting member 6. With the spherical center of the processed surface 9*a* located at the spherical center of the processing surface 8*a* of the polishing tool 8, the moving mechanism unit C moves the supporting member 6 such that the workpiece 9 moves on the polishing tool 8.

Specifically, moving the supporting member 6 involves:

(1) positioning the supporting member 6 of the workpiece holding unit B such that the spherical center of the processed surface 9*a* of the workpiece 9 is located at the spherical center O of the processing surface 8*a* of the polishing tool 8; and (2) making the supporting member 6 serve as an oscillating shaft to move the workpiece 9 (or to cause the workpiece 9 to perform an oscillating movement) on the polishing tool 8, with the spherical center O of the processed surface 9*a* of the workpiece 9 and the processing surface 8*a* of the polishing tool 8 being a center of the oscillation (e.g., making the workpiece 9 reciprocate in the radial (R) direction of the polishing tool 8 (oscillation direction).

In the first embodiment, an articulated arm is used as the moving mechanism unit C. That is, the supporting member 6 is attached to the articulated arm. The articulated arm is formed by a plurality of arms coupled together by a plurality of joints. The articulated arm moves the supporting member 6 by driving each joint. In FIG. 1A, an arm 2 is attached through an arm joint 1 to a frame or the like. An arm 4 is coupled through an arm joint 3 to the arm 2, and the supporting member 6 is coupled through an arm joint 5 to the arm 4. Each of the arm joint 1, the arm joint 3, and the arm joint 5 is driven, for example, by known techniques such as a harmonic drive (registered trademark) and a stepping motor. By controlling the motion of the arm joint 1, the arm joint 3, and the arm joint 5, the supporting member 6 can be moved (or made to perform an oscillating movement), with the spherical center (curvature radius) of the processed surface 9*a* of the workpiece 9 coinciding with the spherical center (curvature radius) of the processing surface 8*a* of the polishing tool 8. With the articulated arm, it is possible to make the workpiece 9 oscillate compactly while positioning the spherical center of the processed surface 9*a* with high accuracy at the spherical center of the processing surface 8*a* of the polishing tool 8, regardless of the contour and curvature radius of the workpiece 9. The cost of the polishing apparatus can be lowered, because the three-joint arm can be formed by three motors, three harmonic drives (registered trademark), and three arms.

However, it is inevitable that the oscillating movement will cause a small spherical center error. The spherical center error refers to a distance between the center of curvature of the surface of the workpiece 9 and a center of curvature of the surface of the polishing tool 8 during oscillating movement. The spherical center error may cause a nonuniform distribution of contact pressure between the surface of the workpiece 9 and the surface of the polishing tool 8 (i.e., uneven contact where pressure is concentrated in a particular area), and may make it difficult to achieve desired shape accuracy. The uneven contact caused by the spherical center error is prevented by allowing inclination of the coupling part 16 between the holding member 7 and the supporting member 6. Thus, even if the spherical center error is large, it is possible to reduce variation in pressure applied from the polishing tool 8 to the workpiece 9 and achieve desired shape accuracy.

A coupling portion between the holding member 7 and the supporting member 6 will now be described in detail. FIG. 1B is a schematic view of an example of the coupling portion.

Referring to FIG. 1B, the holding member 7 holds the workpiece 9, with an elastic sheet 10 interposed therebetween. The workpiece 9 before processing may be a lens or mirror material to be made into an optical member by processing, a resin or metal blank to be made into a mold for molding an optical member such as a lens or a mirror by processing, or a blank to be made into a prototype of an optical member by processing. A component which is obtained by processing the workpiece 9 may be an optical member such as a lens or a mirror, a mold for molding an optical member such as a lens or a mirror, or a prototype of an optical member.

To reduce slippage between the workpiece 9 and the elastic sheet 10, the elastic sheet 10 having a large surface friction coefficient may be used. Also to reduce slippage between the workpiece 9 and the elastic sheet 10, the workpiece 9 may be vacuum-attracted to the holding member 7. The coupling part 16 of the supporting member 6 may be either an integral part of the supporting member 6 or a separate part. The coupling part 16 has the concave spherical portion 161 at an extremity thereof. The concave spherical portion 161 is formed by a concave spherical surface.

The coupling part 16 may be provided with an exhaust flow path 162 that allows the workpiece 9 to be vacuum-attracted to the holding member 7.

The holding member 7 is coupled through the coupling part 16 to the supporting member 6. The holding member 7 has a protrusion 17 at the center thereof. A sliding member 14 is disposed around the protrusion 17. The sliding member 14 comes into contact with the concave spherical portion 161 of the coupling part 16, so that the holding member 7 is connected to the supporting member 6. The sliding member 14 may be made, for example, of synthetic resin or rubber.

The holding member 7 may be provided with an exhaust flow path 172 that allows the workpiece 9 to be vacuum-attracted to the holding member 7. An outer cylinder 11 is attached to the outer periphery of the holding member 7. Since the workpiece 9 is placed inside the outer cylinder 11, the workpiece 9 can be supported at a proper position of the holding member 7 without sticking out of the holding member 7. Also, the workpiece 9 can be restrained in the oscillation direction (R direction).

As described above, by controlling the arm joint 1, the arm joint 3, and the arm joint 5 illustrated in FIG. 1A, the supporting member 6 is made to oscillate, with the spherical center (curvature radius) of the processed surface 9*a* of the workpiece 9 coinciding with the spherical center (curvature radius) of the processing surface 8*a* of the polishing tool 8. This oscillation involves moving the supporting member 6, with the spherical center (curvature radius) of the processed surface 9*a* of the workpiece 9 coinciding with the spherical center (curvature radius) of the processing surface 8*a* of the polishing tool 8 (i.e., making the supporting member 6 reciprocate, with the oscillation center located at O), so as to make the workpiece 9 reciprocate in the radial direction (R direction) of the polishing tool 8. When there is no spherical center error, the oscillation takes place with the central axis of the holding member 7 coinciding with the central axis T of the supporting member 6.

The sliding member 14 is a mechanism that slides on the spherical surface of the concave spherical portion 161 of the coupling part 16. The central axis of the holding member 7 (workpiece 9) can be inclined with respect to the central axis of the supporting member 6, with the center of curvature $P_1$ of the concave spherical portion 161 of the coupling part 16 being a supporting point. The holding member 7 is rotatable with respect to the supporting member 6. Therefore, if a spherical center error occurs during oscillating movement, the central axis of the holding member 7 is freely inclined from the central axis T of the supporting member 6. Since the holding member 7 is rotatable with respect to the supporting member 6, it is possible to allow the workpiece 9 to follow the movement of the processing surface 8*a* of the polishing tool 8 without causing a nonuniform distribution of pressure over the surface of the workpiece 9. It is thus possible to reduce a spherical center error (i.e., variation in distance between the center of curvature of the surface of the workpiece 9 and the center of curvature of the surface of the polishing tool 8 during oscillating movement).

An angle θ between the optical axis (central axis) of the workpiece 9 and a line segment $QP_1$ connecting the center of curvature $P_1$ of the concave spherical portion 161 of the coupling part 16 to a contact point Q between the sliding member 14 and the coupling part 16 may satisfy the following expression (1):

$$\tan\theta \geq \mu \tag{1}$$

where μ is a coefficient of kinetic friction between the workpiece 9 and the polishing tool 8 during polishing. Expression (1) can be expressed by expression (2) below:

$$\frac{d}{2\sqrt{R^2-\left(\frac{d}{2}\right)^2}} \geq \mu \tag{2}$$

where d is a diameter of the sliding member 14 and r is a curvature radius of the concave spherical portion 161 of the coupling part 16.

After the value of θ, R, or d satisfying expression (1) or (2) is determined, the holding member 7, the coupling part 16, and the sliding member 14 are made. It is thus possible to achieve stable polishing without causing the sliding member 14 to fall off the concave spherical portion 161 of the coupling part 16 by frictional force produced between the workpiece 9 and the polishing tool 8 during polishing.

With this configuration, the central axis of the holding member 7 (i.e., the optical axis or central axis of the workpiece 9) is made coaxial with the central axis T of the supporting member 6 when there is no spherical center error. Even if a spherical center error occurs, since the central axis of the holding member 7 can be inclined with respect to the central axis T of the supporting member 6 and the holding member 7 is rotatable with respect to the supporting member 6, the workpiece 9 can be processed with little occurrence of uneven contact, and desired shape accuracy can be achieved. The term "uneven contact" means that a force from the polishing tool 8 is not uniformly applied to the workpiece 9 during processing and is concentrated in a particular area of the workpiece 9.

A distance $D_1$ between the center of curvature $P_1$ of the concave spherical portion 161 of the coupling part 16 and the center of the processed surface 9*a* of the workpiece 9 may be small. A large distance $D_1$ causes a nonuniform distribution of frictional force between the workpiece 9 and the polishing tool 8 during polishing. This increases the moment of the holding member 7 produced about the center of curvature $P_1$ of the concave spherical portion 161 of the coupling part 16, causes uneven contact in the workpiece 9, and makes it difficult to process the workpiece 9 with high accuracy. With the configuration of the first embodiment, however, the distance $D_1$ between the center of curvature $P_1$ of the concave spherical portion 161 of the coupling part 16 and the center of the workpiece 9 can be reduced. Therefore, the workpiece 9 can be processed with high accuracy even when it has a large thickness at the center thereof.

Second Embodiment

Figure 1C:
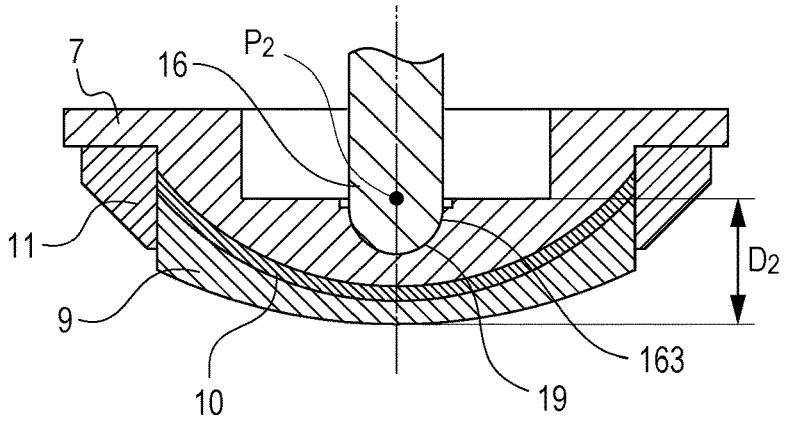
FIGS. 1C and 1D illustrate a second embodiment of the present invention.

A second embodiment of the present invention will now be described. The holding member 7 and the coupling part 16 which are different from those in the first embodiment will be described. FIG. 1C illustrates the holding member 7 and the coupling part 16 of the second embodiment.

The holding member 7 has a concave portion 19 at the center thereof, and the coupling part 16 has a convex spherical portion 163 at an extremity thereof. The concave portion 19 of the holding member 7 is supported by the convex spherical portion 163 of the coupling part 16. The concave portion 19 of the holding member 7 and the convex spherical portion 163 of the coupling part 16 can be inclined. The workpiece 9 is pivotable about a center of curvature $P_2$ of the convex spherical portion 163 of the coupling part 16. Therefore, even if a spherical center error occurs during oscillating movement, the workpiece 9 can follow the movement of the polishing tool 8 without causing a nonuniform distribution of pressure over the surface of the workpiece 9.

As illustrated in FIG. 1C, the concave portion 19 of the holding member 7 in contact with the convex spherical portion 163 of the coupling part 16 may have a spherical shape.

Figure 1D:
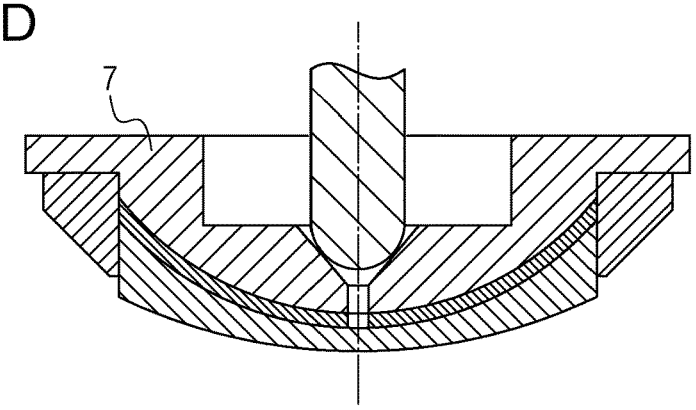

As illustrated in FIG. 1D, the concave portion 19 of the holding member 7 in contact with the convex spherical portion 163 of the coupling part 16 may have a tapered shape.

A distance $D_2$ between the center of curvature $P_2$ of the convex spherical portion 163 of the coupling part 16 and the center of the surface of the workpiece 9 may be small. The distance D between the center of curvature P of the spherical portion of the coupling part 16 and the center of the surface of the workpiece 9 is smaller in the case of the concave spherical portion 161 (first embodiment) than that in the case of the convex spherical portion 163 (second embodiment). Therefore, particularly when the workpiece 9 has a large thickness, the coupling part 16 having the concave spherical portion 161 (first embodiment) may be used.

Third Embodiment

Figure 3B:
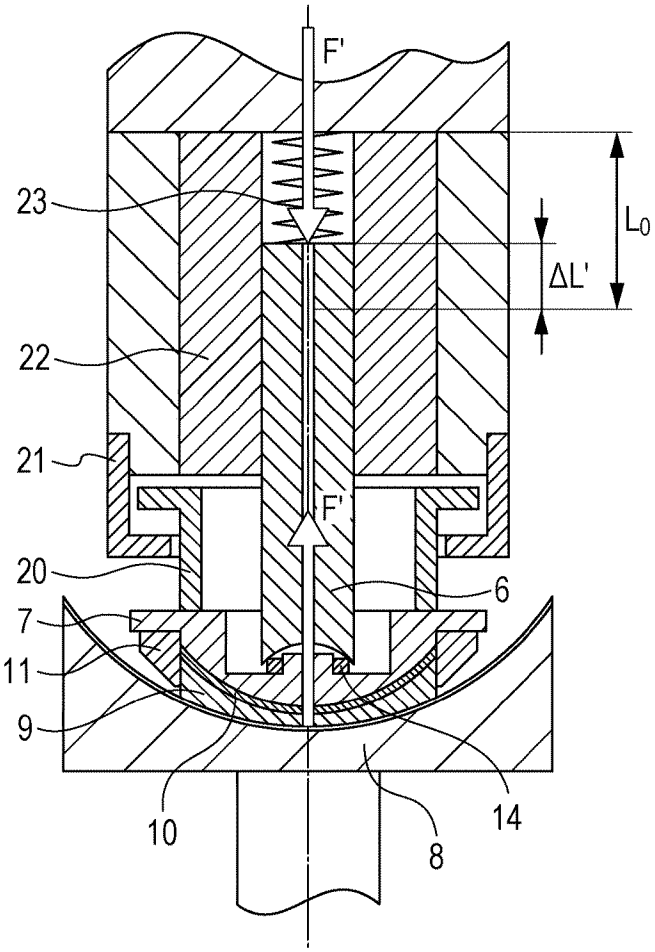
FIGS. 3A and 3B illustrate a third embodiment of the present invention.
Figure 3A:
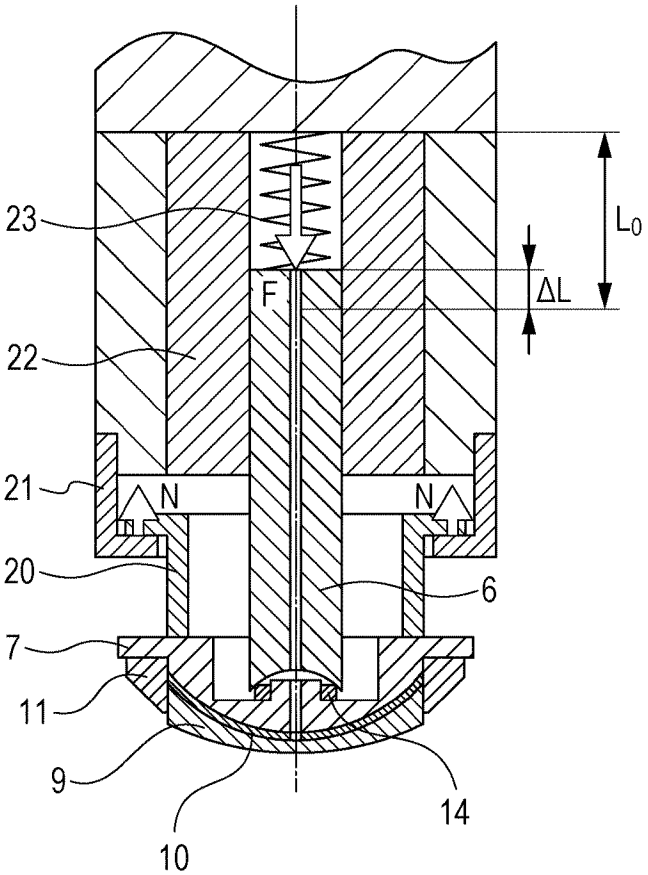

A third embodiment of the present invention will now be described. The third embodiment relates to conveyance of the workpiece 9. FIGS. 3A and 3B illustrate the third embodiment. Parts having the same structures as those in FIGS. 1A to 1D and FIG. 2 are given the same reference numerals and the description thereof will be omitted.

Referring to FIG. 3A, a spring 23 is coupled to an end portion of the supporting member 6, the end portion being different from the concave spherical portion 161 at the other end of the supporting member 6. The supporting member 6 is configured to be movable in a direction (linear motion direction) parallel to the central axis thereof while being guided by a bearing 22. The spring 23 is displaced from its natural length $L_0$ by $\Delta L$ in the compression direction. It is necessary to set $\Delta L$ to be smaller than $\Delta L'$ (described below). A first member 20 secured to the holding member 7 is pressed against a second member 21 by an elastic force F of the compressed spring 23. A normal force N applied from the second member 21 to the first member 20 is balanced with the elastic force F of the spring 23. Thus, since the inclination of the holding member 7, the inclination occurring with the center of curvature of the spherical portion of the supporting member 6 being a supporting point, is restrained and the position of the holding member 7 is stabilized, the workpiece 9 can be automatically conveyed in a stable manner.

During polishing, as illustrated in FIG. 3B, the polishing tool 8 pushes the workpiece 9 in the direction of compression of the spring 23 by $\Delta L'$, so that the resulting elastic force F' of the spring 23 gives a desired pressure F' to the workpiece 9. Therefore, during polishing, the first member 20 is brought out of contact with the second member 21, and the holding member 7 can be inclined, with the center of curvature of the spherical portion of the supporting member 6 being a supporting point.

With the polishing method described above, desired shape accuracy of the workpiece 9 can be achieved during polishing even if a spherical center error is large. Also, the position of the holding member 7 for holding the workpiece 9 (component) is stabilized during automatic conveyance, and the workpiece 9 (component) can be conveyed in a stable manner.

The first member 20 or the second member 21 is provided with a mechanism (e.g., a known technique of providing a groove) that transmits rotation of the second member 21 to the first member 20 when the first member 20 and the second member 21 are in a non-contact state. Then by applying rotation from the work rotating mechanism 61 to the second member 21, the holding member 7 can be rotated, so that the workpiece 9 can be processed while being rotated.

Example 1

In Example 1, an optical member was processed using the first embodiment. A piece of general optical glass having an outside diameter $\phi$ of 25 mm, a convex shape with a curvature radius R of 28 mm, and a central thickness of 2 mm was used as the optical member.

Polishing was carried out by controlling the arm joint 1, the arm joint 3, and the arm joint 5 illustrated in FIG. 1A to perform an oscillating movement, with the curvature radius of the surface of the workpiece 9 coinciding with the curvature radius of the surface of the polishing tool 8. The oscillating movement was performed in a range where the angle of inclination of the central axis of the workpiece 9 with respect to the central axis of the polishing tool 8 was between 20 degrees and 28 degrees, at a speed of 8 seconds for each reciprocation cycle. In Example 1, the spherical center error during oscillating movement in polishing was 180 μm.

In the workpiece holding unit illustrated in FIG. 1B, an elastic member having a rubber hardness of about 30 on the Asker A scale was used as the elastic sheet 10. Also, the outer cylinder 11 made of synthetic resin, the holding member 7 made of stainless steel, the sliding member 14 made of synthetic resin, and the supporting member 6 made of stainless steel were used. Grease for machines was applied to a contact portion between the sliding member 14 and the supporting member 6 for the purposes of enhanced slidability and wear resistance. The angle θ (see FIG. 1B) formed between the central axis of the workpiece 9 and the line segment $QP_1$ connecting the center of curvature $P_1$ of the concave spherical portion 161 of the coupling part 16 to the contact point Q between the sliding member 14 and the coupling part 16 was set to 41.8 degrees. The diameter d of the sliding member 14 was set to 8 mm and the curvature radius r of the concave spherical portion 161 of the coupling part 16 was set to 6 mm, so as to satisfy expressions (1) and (2). The coefficient of kinetic friction μ during polishing was assumed to be 0.9. The distance $D_1$ (see FIG. 1B) between the center of curvature $P_1$ of the concave spherical portion 161 of the coupling part 16 and the center of the surface of the workpiece 9 was set to 2.3 mm. The polishing tool 8 (see FIG. 1A) formed by attaching a foamed polyurethane member to a tool base was used. Slurry obtained by adding a cerium oxide polishing agent to water was used as a polishing solution. In polishing, the rotation speed of the polishing tool 8 was 1800 rpm, the rotation speed of the workpiece 9 was 1800 rpm, and the processing surface pressure was 26 kPa.

Figure 4:
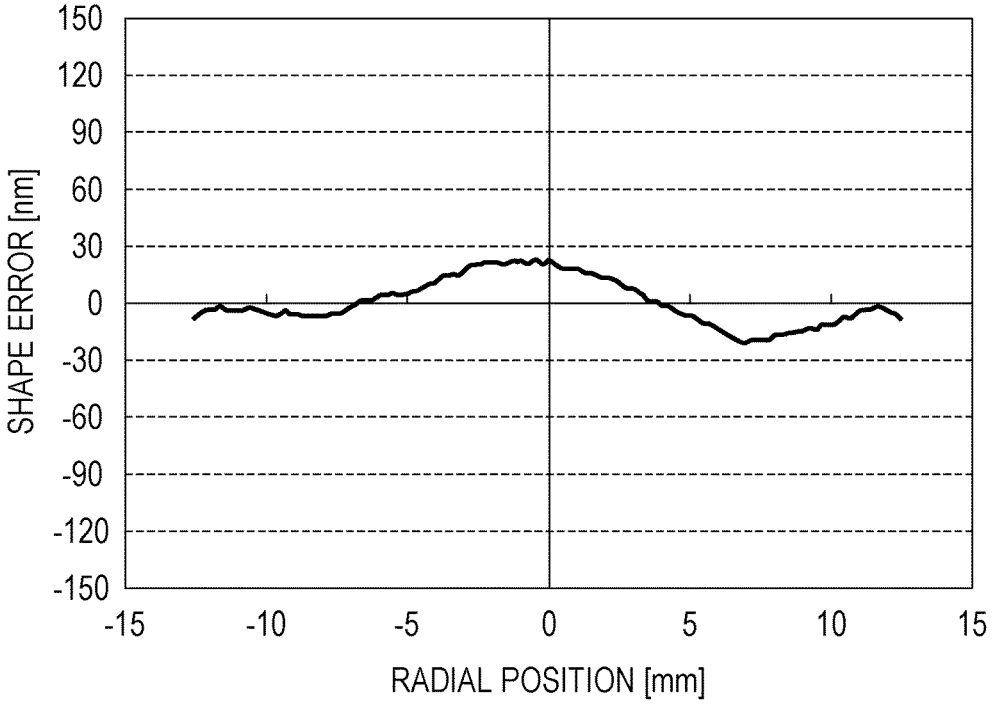
FIG. 4 illustrates a shape error in Example 1 of the present invention.

FIG. 4 shows a shape error in a component (processed workpiece) obtained by polishing using the configuration and conditions described above. A peak-to-valley (PV) value representing the shape error was less than 100 nm and desired shape accuracy was achieved. With the polishing method of the present invention, even if the spherical center error was relatively large, the contact pressure between the surface of the workpiece 9 and the surface of the polishing tool 8 was distributed uniformly, and desired component shape accuracy was achieved.

Example 2

In Example 2, an optical member was processed using the second embodiment. A piece of general optical glass having an outside diameter ϕ of 18 mm, a concave shape with a curvature radius R of 16 mm, and a central thickness of 1 mm was used as the optical member.

Like Example 1, polishing was carried out by controlling the arm joint 1, the arm joint 3, and the arm joint 5 illustrated in FIG. 1A to perform an oscillating movement, with the curvature radius of the surface of the workpiece 9 coinciding with the curvature radius of the surface of the polishing tool 8. The oscillating movement was performed in a range where the angle of inclination of the rotation axis of the workpiece 9 with respect to the rotation axis of the polishing tool 8 was between 27 degrees and 37 degrees, at a speed of 8 seconds per reciprocation cycle. In Example 2, the spherical center error during oscillating movement in polishing was 150 μm.

In the workpiece holding unit illustrated in FIG. 1C, the elastic sheet 10 having a rubber hardness of about 30 on the Asker A scale, the outer cylinder 11 made of synthetic resin, and the holding member 7 and the supporting member 6 made of stainless steel were used. To improve wear resistance, the convex spherical portion 163 of the coupling part 16 was quenched and tempered. Grease for machines was applied to a contact portion between the holding member 7 and the supporting member 6 for the purposes of enhanced slidability and wear resistance. The distance $D_2$ between the center of curvature $P_2$ of the convex spherical portion 163 of the coupling part 16 and the center of the surface of the workpiece 9 was set to 8.5 mm. The polishing tool 8 (see FIG. 1A) having the same configuration as that in Example 1 was used. A polishing solution having the same composition as that in Example 1 was used. In polishing, the rotation speed of the polishing tool 8 was 2400 rpm, the rotation speed of the workpiece 9 was 2400 rpm, and the processing surface pressure was 26 kPa.

Figure 5:
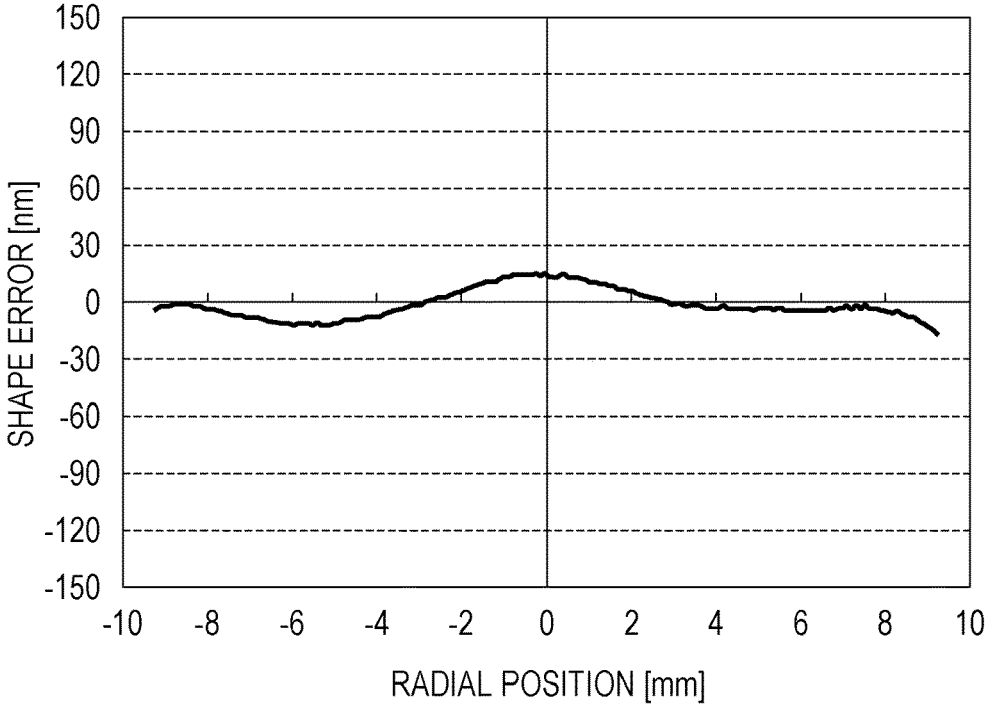
FIG. 5 illustrates a shape error in Example 2 of the present invention.

FIG. 5 shows a shape error in a component (processed workpiece) obtained by polishing using the configuration and conditions described above. A PV value representing the shape error was less than 100 nm and desired shape accuracy was obtained. As described above, with the polishing method of the present invention, even if the spherical center error is relatively large, the contact pressure between the surface of the workpiece 9 and the surface of the polishing tool 8 was distributed uniformly, and desired component shape accuracy was achieved.

Example 3

In Example 3, the same processing as that in Example 2 was carried out and automatic conveyance described in the third embodiment was performed. As illustrated in FIG. 6A, the workpiece 9 on a stand 25 was raised by a cylinder 24, inserted and attracted into the outer cylinder 11 of the holding member 7, and automatically conveyed. The holding member 7 having the configuration illustrated in FIG. 3A was used. A coil spring having a spring constant k of 1.77 N/mm and a natural length $L_0$ of 35 mm was used as the spring 23. The spring 23 was displaced by a length ΔL of 2 mm in the compression direction. Since the first member 20 was pressed against the second member 21 by an elastic force F of 3.54 N of the spring 23, the inclination of the holding member 7 was restrained, the inclination occurring with the center of curvature of the spherical portion of the supporting member 6 being a supporting point. Therefore, the position of the holding member 7 was stabilized and the workpiece 9 was automatically conveyed in a stable manner.

Figure 6B:
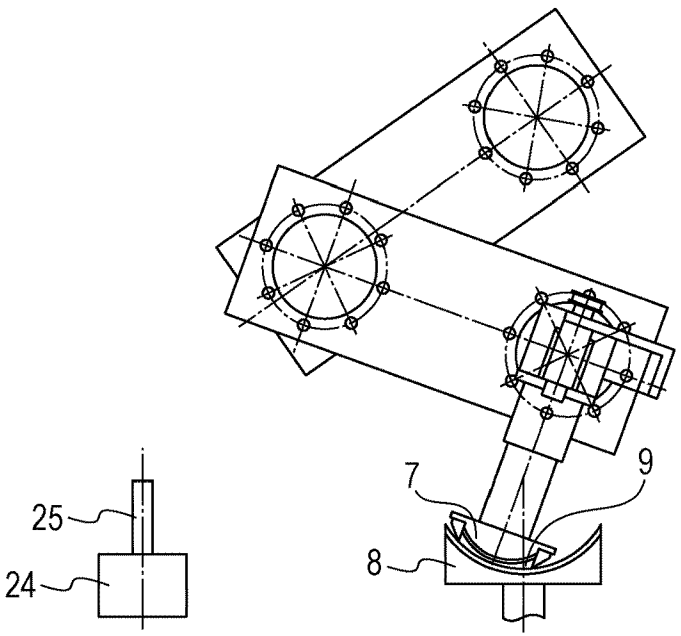
FIGS. 6A and 6B illustrate Example 3 of the present invention.
Figure 6A:
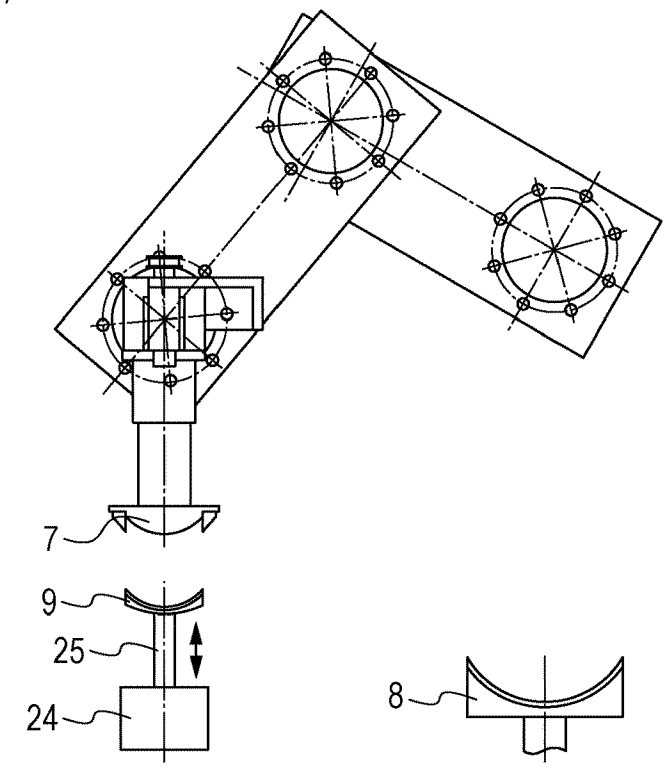

Next, the workpiece 9 held by the holding member 7 in FIG. 6A was conveyed by an arm unit, and pressed against the polishing tool 8 and polished as in FIG. 6B. The processing conditions used in the polishing were the same as those in Example 2. To realize a processing surface pressure of 26 kPa, the spring 23 in FIG. 3B was displaced from its natural length $L_0$ by a length ΔL' of 3.9 mm in the compression direction. During polishing, as illustrated in FIG. 3B, the first member 20 was brought out of contact with the second member 21, and the holding member 7 could be inclined, with the center of curvature of the spherical portion of the supporting member 6 being a supporting point. With the configuration described above, 50 workpieces were automatically conveyed and polished. The conveyance was done without problem and desired shape accuracy was achieved.

Fourth Embodiment

A fourth embodiment of a component manufacturing method according to the present invention will be described. The fourth embodiment does not include the rotation transmitting member 62 of the first embodiment. The same configuration as that of the first embodiment will not be described here.

Referring to FIG. 1A, the polishing tool unit A includes the polishing tool 8, which may be rotated by a tool rotating mechanism (not shown) about the tool central axis S. A polishing tool that is known in the art may be used as the polishing tool 8. For example, a layer of urethane sheets bonded together or a layer of pitch may be used as the polishing tool 8.

The workpiece holding unit B includes the holding member 7 for holding the workpiece 9 and the supporting member 6. The holding member 7 holds the workpiece 9 such that the optical axis passing through the spherical center O of the processed surface 9*a* of the workpiece 9 is located on the central axis of the holding member 7. The spherical center of the workpiece 9 may be either a spherical center of the workpiece 9 before polishing or a spherical center of a shape to be obtained by polishing (i.e., target shape), but the latter is more preferable.

The moving mechanism unit C is configured to move the supporting member 6. With the spherical center of the processed surface 9*a* located at the spherical center of the processing surface 8*a* of the polishing tool 8, the moving mechanism unit C moves the supporting member 6 such that the workpiece 9 moves on the polishing tool 8.

Specifically, moving the supporting member 6 involves:

(1) positioning the supporting member 6 of the workpiece holding unit B such that the spherical center of the processed surface 9*a* of the workpiece 9 is located at the spherical center O of the processing surface 8*a* of the polishing tool 8; and (2) making the supporting member 6 serve as an oscillating shaft to move the workpiece 9 (or to cause the workpiece 9 to perform an oscillating movement) on the polishing tool 8, with the spherical center O of the processed surface 9*a* of the workpiece 9 and the processing surface 8*a* of the polishing tool 8 being a center of the oscillation (e.g., making the workpiece 9 reciprocate in the radial (R) direction of the polishing tool 8 (oscillation direction).

Moving the supporting member 6 involves using an articulated arm as the moving mechanism unit C. That is, the supporting member 6 is attached to the articulated arm. The articulated arm is formed by a plurality of arms coupled together by a plurality of joints. The articulated arm moves the supporting member 6 by driving each joint. In FIG. 1A, the arm 2 is attached through the arm joint 1 to a frame or the like. The arm 4 is coupled through the arm joint 3 to the arm 2, and the supporting member 6 is coupled through the arm joint 5 to the arm 4. Each of the arm joint 1, the arm joint 3, and the arm joint 5 is driven, for example, by known techniques such as a harmonic drive (registered trademark) and a stepping motor. By controlling the motion of the arm joint 1, the arm joint 3, and the arm joint 5, the supporting member 6 can be moved (or made to perform an oscillating movement), with the spherical center (curvature radius) of the processed surface 9*a* of the workpiece 9 coinciding with the spherical center (curvature radius) of the processing surface 8*a* of the polishing tool 8. With the articulated arm, it is possible to make the workpiece 9 oscillate compactly while positioning the spherical center of the processed surface 9*a* with high accuracy at the spherical center of the processing surface 8*a* of the polishing tool 8, regardless of the contour and the curvature radius of the workpiece 9. The cost of the polishing apparatus can be lowered, because the three-joint arm can be formed by three motors, three harmonic drives (registered trademark), and three arms.

However, it is inevitable that the oscillating movement will cause a small spherical center error. The spherical center error refers to a distance between the center of curvature of the surface of the workpiece 9 and the center of curvature of the surface of the polishing tool 8 during oscillating movement. The spherical center error may cause a nonuniform distribution of contact pressure between the surface of the workpiece 9 and the surface of the polishing tool 8 (i.e., uneven contact where pressure is concentrated in a particular area), and may make it difficult to achieve desired shape accuracy. The uneven contact caused by the spherical center error is prevented by allowing inclination of the coupling part 16 between the holding member 7 and the supporting member 6. The coupling part 16 between the holding member 7 and the supporting member 6 will not be described here, as it is the same as that in the first embodiment. Thus, even if the spherical center error is large, it is possible to reduce variation in pressure applied from the polishing tool 8 to the workpiece 9 and achieve desired shape accuracy.

The present invention enables the workpiece 9 and the polishing tool 8 to relatively move with high accuracy. It is thus possible not only to process the workpiece 9 with high accuracy, but also to narrow the range of oscillation and lower the cost of the apparatus. It is also possible to control the speed of relative movement of the workpiece 9 and the polishing tool 8 and to shorten the processing time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A component manufacturing method for manufacturing a component by moving a workpiece having a spherical processed surface with respect to a polishing tool having a spherical processing surface to polish the workpiece, the component manufacturing method comprising:

causing a holding member to hold the workpiece such that a spherical center of the processed surface of the workpiece is located on a central axis of the holding member;

pressing the processed surface of the workpiece against the processing surface of the polishing tool; and moving the holding member, by a moving mechanism, such that the spherical center of the processed surface of the workpiece is positioned at a spherical center of the processing surface of the polishing tool and that the workpiece held by the holding member reciprocates on the processing surface of the polishing tool, wherein the moving mechanism comprises an articulated arm formed by a plurality of arms pivotally coupled together by a plurality of rotary joints, and wherein each of the plurality of rotary joints rotates about a rotational axis and is independently driven, and wherein at least three of the rotational axes about which respective rotary joints rotate are substantially parallel to each other.

2. The component manufacturing method according to claim 1, wherein a concave spherical portion at an extremity of a supporting member of one of the plurality of arms is brought into contact with a sliding member at a center of the holding member, and the holding member is held to be freely inclined with respect to the supporting member.

3. The component manufacturing method according to claim 1, wherein a convex spherical portion at an extremity of a supporting member of one of the plurality of arms is brought into contact with a concave portion at a center of the holding member, and the holding member is held to be freely inclined with respect to the supporting member.

4. The component manufacturing method according to claim 3, wherein the concave portion has a spherical shape.

5. The component manufacturing method according to claim 3, wherein the concave portion has a tapered shape.

6. The component manufacturing method according to claim 3, wherein the inclination of the holding member with respect to the supporting member is restrained by coupling a first member to the holding member and bringing a second member into contact with the first member.

7. The component manufacturing method according to claim 6, wherein the workpiece is rotated by coupling a rotation transmitting member to the second member and causing the rotation transmitting member to transmit rotation from the work rotating mechanism to the holding member.

8. The component manufacturing method according to claim 1, wherein a rotation transmitting member is coupled to the holding member, and the rotation transmitting member transmits rotation from the work rotating mechanism to the holding member.

9. The component manufacturing method according to claim 1, wherein the component manufactured by polishing is an optical member, a mold for molding the optical member, or a prototype of the optical member.

10. The component manufacturing method according to claim 1, wherein the number of the plurality of arms is three, and wherein the number of the plurality of rotary joints is also three.

11. The component manufacturing method according to claim 1, wherein the articulated arm comprises at least a first arm configured to be moved by driving a motor, a second arm coupled to the first arm via a first joint, and a supporting member coupled to the second arm via a second joint, and wherein the first joint is driven by a first motor, the second joint is driven by a second motor, and the supporting member is connected to the holding member.

12. An optical device having a lens manufactured according to the component manufacturing method of claim 1.

13. A polishing apparatus that polishes a workpiece by moving the workpiece having a spherical processed surface with respect to a polishing tool having a spherical processing surface, the polishing apparatus comprising:

a holding member configured to hold the workpiece such that a spherical center of the processed surface of the workpiece is located on a central axis of the holding member; and a moving mechanism configured to move the holding member such that the spherical center of the processed surface of the workpiece is positioned at a spherical center of the processing surface of the polishing tool and that the workpiece held by the holding member reciprocates on the processing surface of the polishing tool, wherein the moving mechanism comprises an articulated arm formed by a plurality of arms pivotally coupled together by a plurality of rotary joints, and wherein each of the plurality of rotary joints rotates about a rotational axis and is independently driven, and wherein at least three of the rotational axes about which respective rotary joints rotate are substantially parallel to each other.

14. The polishing apparatus according to claim 13, wherein a sliding member at a center of the holding member and a concave spherical portion at an extremity of a supporting member of one of the plurality of arms allow the holding member and the supporting member to come into contact with each other.

15. The polishing apparatus according to claim 13, wherein a concave portion at a center of the holding member and a convex spherical portion at an extremity of a supporting member of one of the plurality of arms allow the holding member and the supporting member to come into contact with each other.

16. The polishing apparatus according to claim 15, wherein the concave portion has a spherical shape.

17. The polishing apparatus according to claim 15, wherein the concave portion has a tapered shape.

18. The polishing apparatus according to claim 13, wherein the number of the plurality of arms is three, and wherein the number of the plurality of rotary joints is also three.

19. The polishing apparatus according to claim 13, wherein a supporting member includes a rotation transmitting member, wherein the rotation transmitting member is coupled to the holding member, and wherein the rotation transmitting member transmits rotation from the work rotating mechanism to the holding member.

20. The polishing apparatus according to claim 13, wherein a supporting member moves to position the holding member so that the spherical center of a processed surface of the workpiece is positioned at a spherical center of a processing surface of the polishing tool and to be made to perform an oscillating movement.

* * * * *